US009989328B2

(12) United States Patent
Ding et al.

(10) Patent No.: US 9,989,328 B2
(45) Date of Patent: Jun. 5, 2018

(54) SYSTEM AND METHOD FOR FIREARM RAIL COVER

(71) Applicant: Leapers, Inc., Livonia, MI (US)

(72) Inventors: Tai-Lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days. days.

(21) Appl. No.: 15/392,004

(22) Filed: Dec. 28, 2016

(65) Prior Publication Data

US 2017/0205183 A1 Jul. 20, 2017

Related U.S. Application Data

(60) Provisional application No. 62/278,782, filed on Jan. 14, 2016.

(51) Int. Cl.
*F41A 35/02* (2006.01)
*F41C 23/16* (2006.01)

(52) U.S. Cl.
CPC ..... *F41A 35/02* (2013.01); *F41C 23/16* (2013.01)

(58) Field of Classification Search
CPC ..... F41C 23/16; F41C 23/14; F41C 27/00; F41A 35/02; F41A 35/00; F41G 11/003
See application file for complete search history.

(56) References Cited

U.S. PATENT DOCUMENTS

| | | | | |
|---|---|---|---|---|
| 6,782,652 | B1 * | 8/2004 | Erickson | F41A 35/02 42/124 |
| D691,235 | S * | 10/2013 | Fitzpatrick | D22/108 |
| D704,789 | S * | 5/2014 | Fitzpatrick | D22/108 |
| D704,791 | S * | 5/2014 | Fitzpatrick | D22/108 |
| 8,935,874 | B2 * | 1/2015 | Troy | F41A 35/02 42/90 |
| D730,474 | S * | 5/2015 | Ding | D22/108 |
| 9,222,749 | B1 * | 12/2015 | Nakayama | F41C 23/16 |
| D755,332 | S * | 5/2016 | Kielsmeier | D22/108 |
| D758,518 | S * | 6/2016 | Daniel | D22/108 |
| D759,185 | S * | 6/2016 | Kielsmeier | D22/108 |
| 9,441,905 | B2 * | 9/2016 | Hines | F41C 23/16 |
| 9,448,030 | B2 * | 9/2016 | Hines | F41C 27/00 |
| 9,625,233 | B2 * | 4/2017 | Daniel | F41C 23/16 |
| 9,766,035 | B2 * | 9/2017 | Storch | F41C 23/16 |
| 2003/0106252 | A1 * | 6/2003 | Hines | F41A 35/02 42/90 |
| 2009/0241397 | A1 * | 10/2009 | Fitzpatrick | F41C 23/16 42/90 |
| 2012/0085013 | A1 * | 4/2012 | Cahill | F41A 35/02 42/96 |

(Continued)

OTHER PUBLICATIONS

Webpage http://www.recoilweb.com/wedgelok-keymod-and-m-lok=63961.html pp. 1-5, Recoil Staff, dated Apr. 28, 2015.*

*Primary Examiner* — Benjamin P Lee
(74) *Attorney, Agent, or Firm* — Honigman Miller Schwartz and Cohn LLP

(57) ABSTRACT

A rail insert is disclosed. The rail insert includes a backing member, at least one locating pin connected to the backing member, and at least one locking pin connected to the backing member. The backing member has a rail side and a grip side. The at least one locking pin has at least one compressible member.

2 Claims, 11 Drawing Sheets

(56) References Cited

U.S. PATENT DOCUMENTS

| | | | | |
|---|---|---|---|---|
| 2012/0266514 | A1* | 10/2012 | Michal | F41C 23/16 42/90 |
| 2014/0325889 | A1* | 11/2014 | Michal | F41G 11/003 42/75.01 |
| 2016/0091272 | A1* | 3/2016 | Hines | F41C 23/16 42/90 |
| 2016/0116246 | A1* | 4/2016 | Daniel | F41C 23/16 42/90 |
| 2016/0169610 | A1* | 6/2016 | Hines | F41C 27/00 42/90 |
| 2016/0216061 | A1* | 7/2016 | Cheng | F41C 27/00 |

* cited by examiner

SYSTEM AND METHOD FOR FIREARM RAIL COVER

CROSS REFERENCE TO RELATED APPLICATIONS

This U.S. patent application claims priority under 35 U.S.C. § 119(e) to U.S. Provisional Application 62/278,782, filed on Jan. 14, 2016. The disclosure of this prior application is considered part of the disclosure of this application and is hereby incorporated by reference in its entireties.

TECHNICAL FIELD

This disclosure relates to a system and method for a firearm rail cover.

BACKGROUND

This section provides background information related to the present disclosure and is not necessarily prior art.

It is common for firearms to use various rail systems to attach firearm accessories. Over the years, the various rail systems have included the Weaver rail, the Picatinny rail (also known as the tactical rail or MIL-STD-1913 rail), the KeyMod rail, and the M-LOK rail system. Each different system has had its benefits and its shortcomings, but has been used to mount accessories such as scopes, sights, vision devices, bayonets, grips, covers, stands, stops, etc. More recently, there has been an effort to standardize attachment systems with the more modern KeyMod rail system or M-LOK rail system. As firearm and firearm attachment manufacturers use these more modern systems, the means of attaching firearm accessories has been modified to accommodate.

While systems and methods for attaching firearm rail covers have proven useful for their intended purposes, a need for continuous improvement in the pertinent art remains.

SUMMARY

One aspect of the disclosure provides a rail insert. The rail insert includes a backing member, at least one locating pin connected to the backing member, and at least one locking pin connected to the backing member. The backing member has a rail side and a grip side. The at least one locking pin has at least one compressible member.

Implementations of the disclosure may include one or more of the following optional features. In some implementations, a rail insert wherein the backing member is generally planar. The at least one compressible member may be compressible along an axis that is generally parallel to a generally planar backing member. The locking pin may have a first compressible member and a second compressible member. The grip side may have at least one grip indentation. The backing member may have at least one ejection indentation.

In some examples, the at least one compressible member has a chamfered portion. The chamfered portion may engage with a firearm rail. At least one locating pin may have a shoulder portion. The shoulder portion may be defined by a first width of the shoulder portion adjacent to the backing member that is less than a second width of the shoulder portion opposite the backing member.

Another aspect of the disclosure provides a method of making a rail insert. The method includes receiving a mold configured to form the rail insert having a backing member, at least one locating pin, and at least one locking pin. The backing member has a rail side and a grip side. The at least one locking pin has at least one compressible member. The method also includes injecting a moldable material into the mold and removing the rail insert from the mold.

This aspect may include one or more of the following optional features. In some implementations, the backing member is generally planar. The at least one compressible member may be compressible along an axis that is generally parallel to a generally planar backing member. The locking pin may have a first compressible member and a second compressible member.

In some examples, the grip side has a plurality of grip indentations. The backing member may have at least one ejection indentation. The at least one compressible member may have a chamfered portion. The chamfered portion may engage with a firearm rail. At least one locating pin may have a shoulder portion. The shoulder portion may be defined by a first width of the shoulder portion adjacent to the backing member that is less than a second width of the shoulder portion opposite the backing member.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
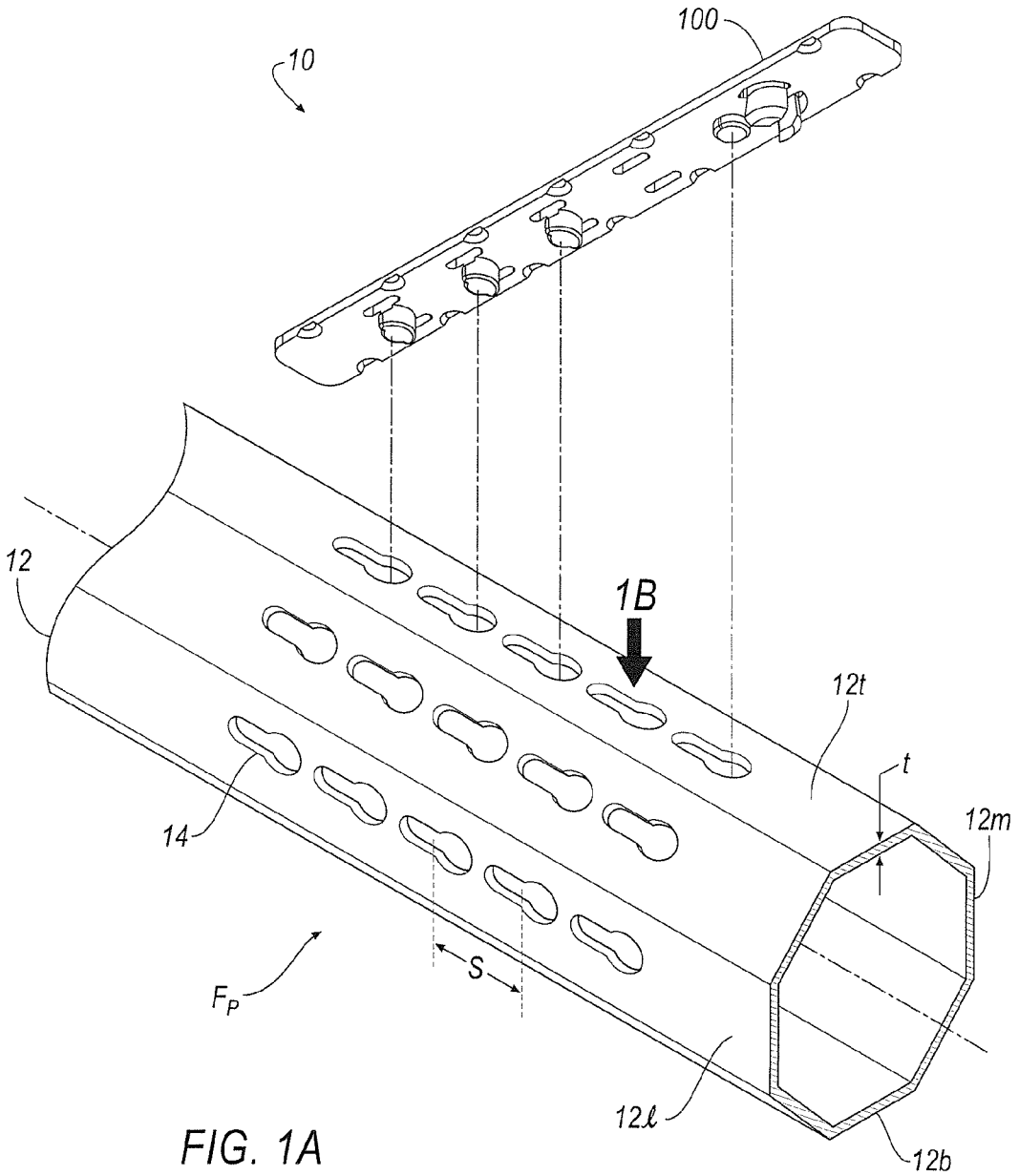
FIG. 1A is an example perspective view of a firearm rail and a rail insert.

Referring to FIG. 1A, a firearm environment 10 includes a firearm rail 12 and at least one rail key slot 14. The firearm rail 12 is a surface (e.g., a cylinder) or more than one surface (e.g., octagonal prism of FIG. 1A) of a firearm with thickness, t, that permits attachment of firearm accessories, such as a scope, a sight, a stand, a bayonet, etc. The firearm rail 12 has a longitudinal axis that extends along a barrel portion of the firearm. The firearm rail 12 has a firearm rail lateral side 12*l*, a firearm rail medial side 12*m*, a firearm rail top side 12*t*, and a firearm rail bottom side 12*b*. The firearm rail lateral side 12*l* is a side of the firearm rail 12 that faces away from the body of a firearm user. The firearm rail medial side 12*m* is a side of the firearm rail 12 that faces toward the body of the firearm user. The firearm rail top side 12*t* is a side of the firearm rail 12 that faces opposite the ground plane when the firearm with the firearm rail 12 is in an upright firing position $F_p$. The firearm rail bottom side 12*b* is a side of the firearm rail 12 that faces the ground plane when the firearm with the firearm rail 12 is in the upright firing position $F_p$. To attach firearm accessories to the firearm rail 12, the firearm rail 12 includes at least one rail key slot 14. In some examples, the firearm rail 12 has a plurality of rail key slots 14 with spacing S between each rail key slot 14 of the plurality of rail key slots 14.

Figure 1B:
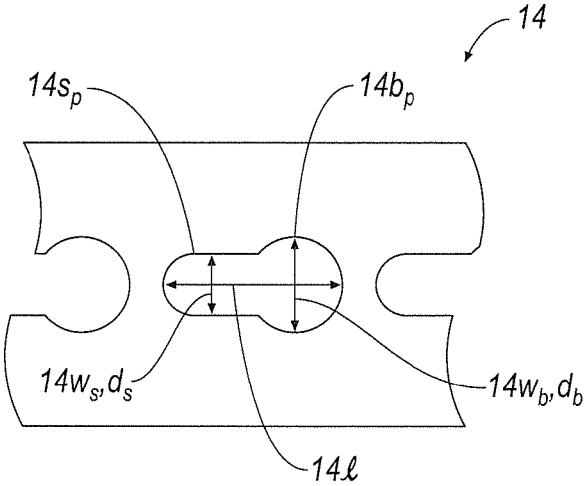
FIG. 1B is an enlarged example top view of a rail key slot.

FIG. 1B is an example of a rail key slot 14 of the at least one rail key slot 14. In some implementations, the rail key slot 14 of the firearm rail 12 includes a bow portion 14*bp* and a slot portion 14*sp*. The rail key slot 14 transitions from the bow portion 14*bp* to the slot portion 14*sp* such that the bow portion has a width $\mathbf{14}w_b$ greater than a width $\mathbf{14}w_s$ of the slot portion. The rail key slot 14 has a length 14*l*. FIG. 1B illustrates that in some implementations the rail key slot 14 may have a bow portion diameter $d_b$ of the bow portion 14*bp* and a slot portion diameter $d_s$ of the slot portion 14*sp* that is equivalent to the width $\mathbf{14}w_b$ of the bow portion 14*bp* and the width $\mathbf{14}w_s$ of the slot portion 14*sp* respectfully.

Figure 1C:
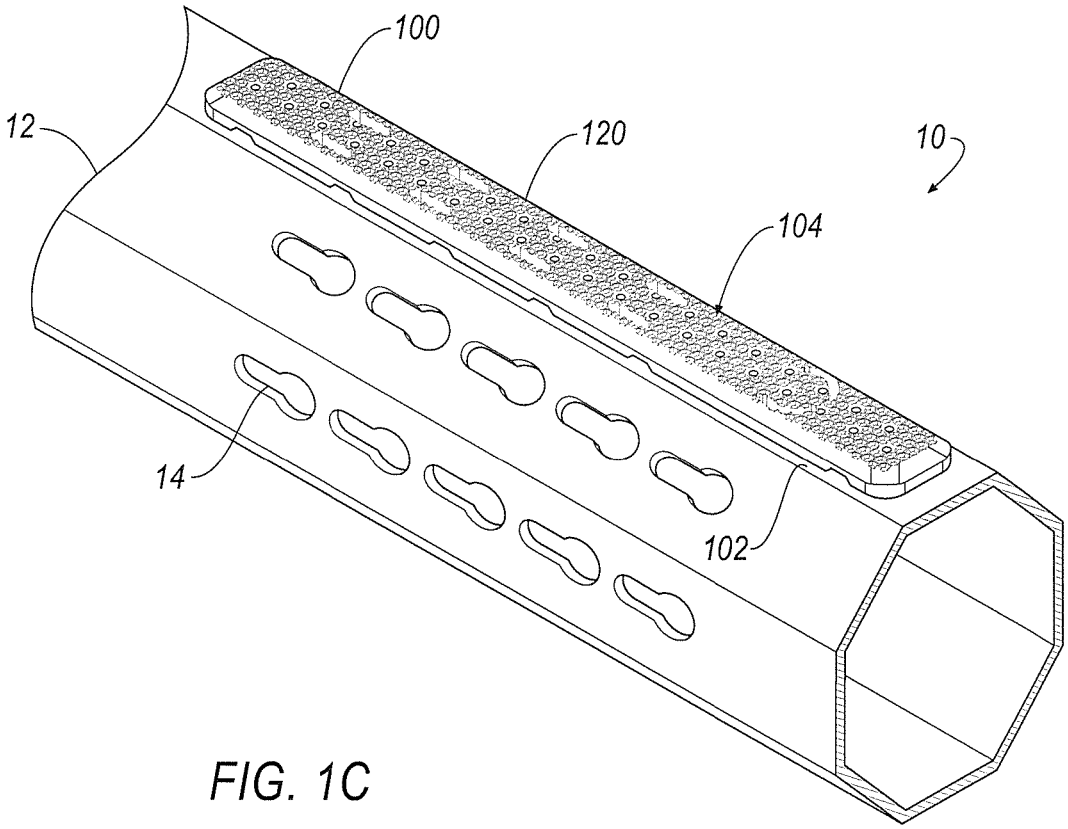
FIG. 1C is an example perspective view of a firearm rail and a rail insert.
Figure 2A:
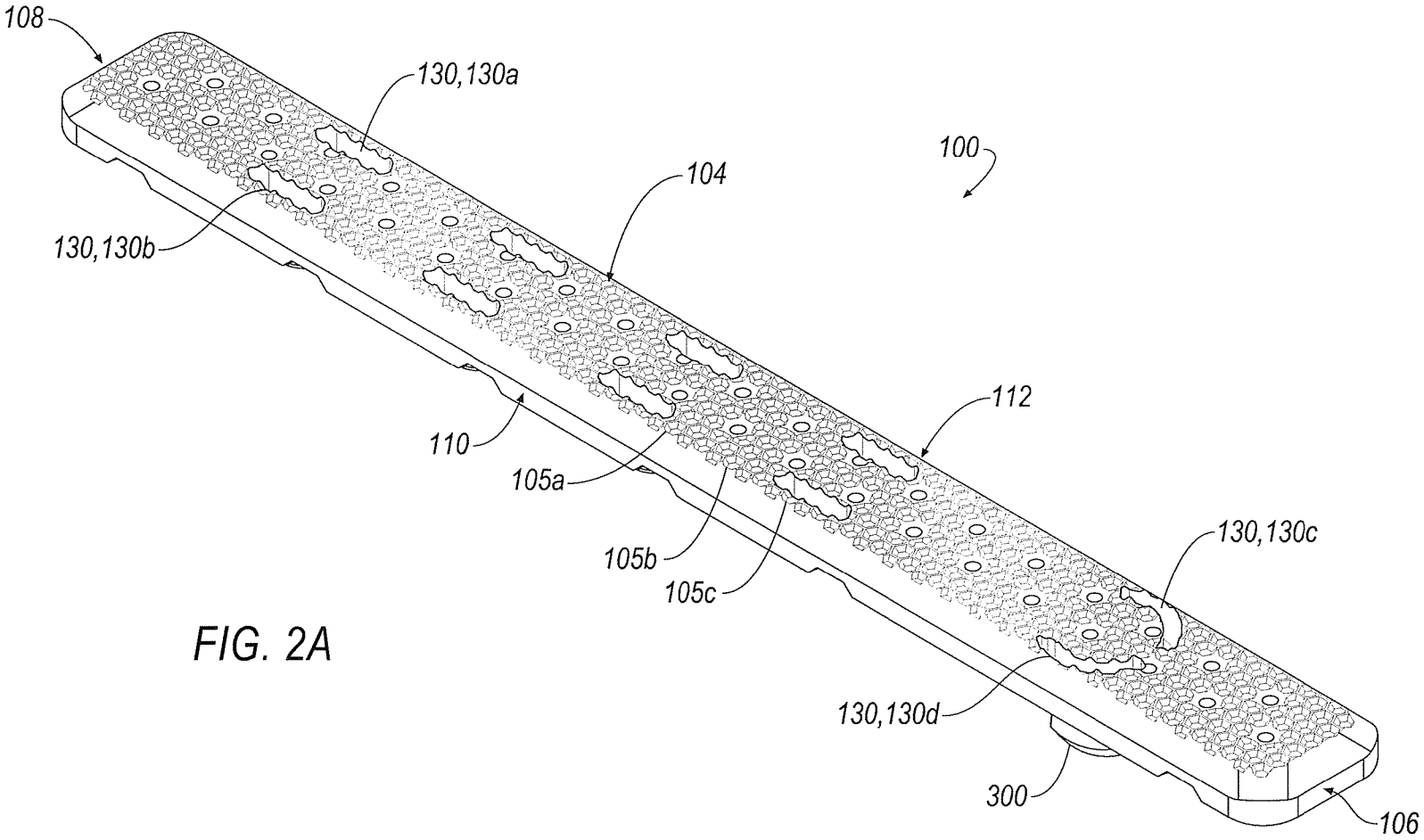
FIG. 2A is an example perspective view of a grip side of a rail insert.
Figure 2B:
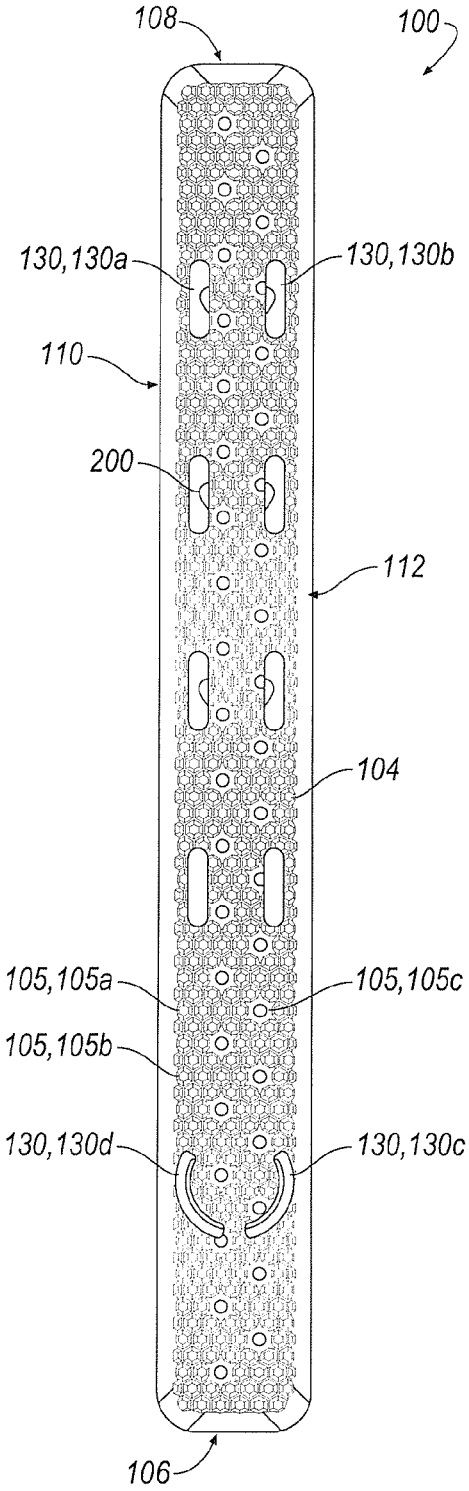
FIG. 2B is an example top view of a grip side of a rail insert.
Figure 2D:
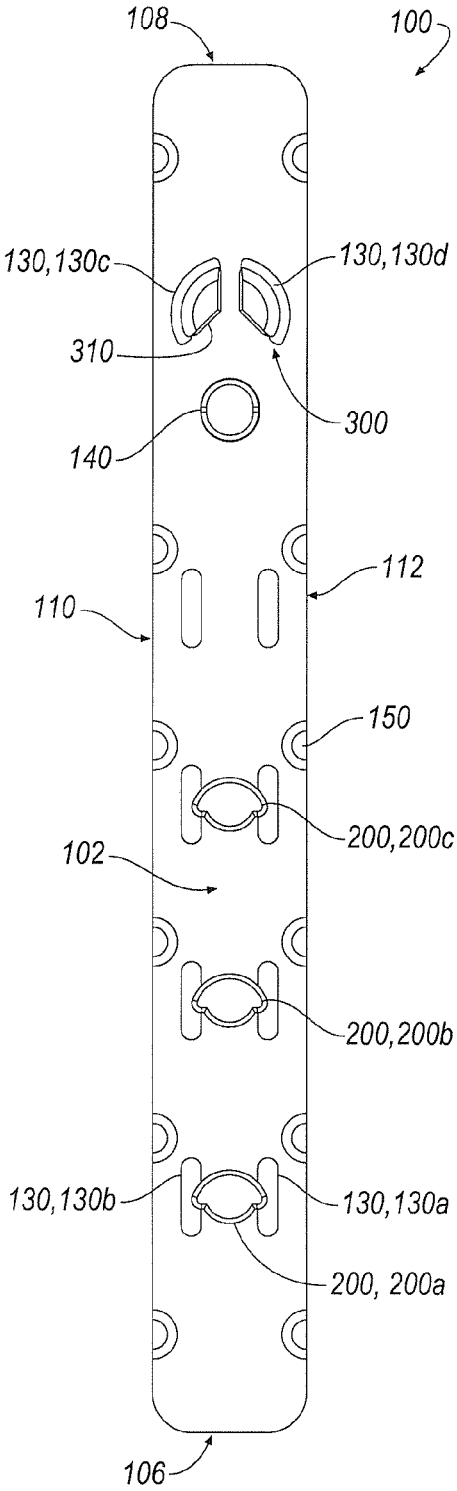
FIG. 2D is an example top view of a rail side of a rail insert.
Figure 2C:
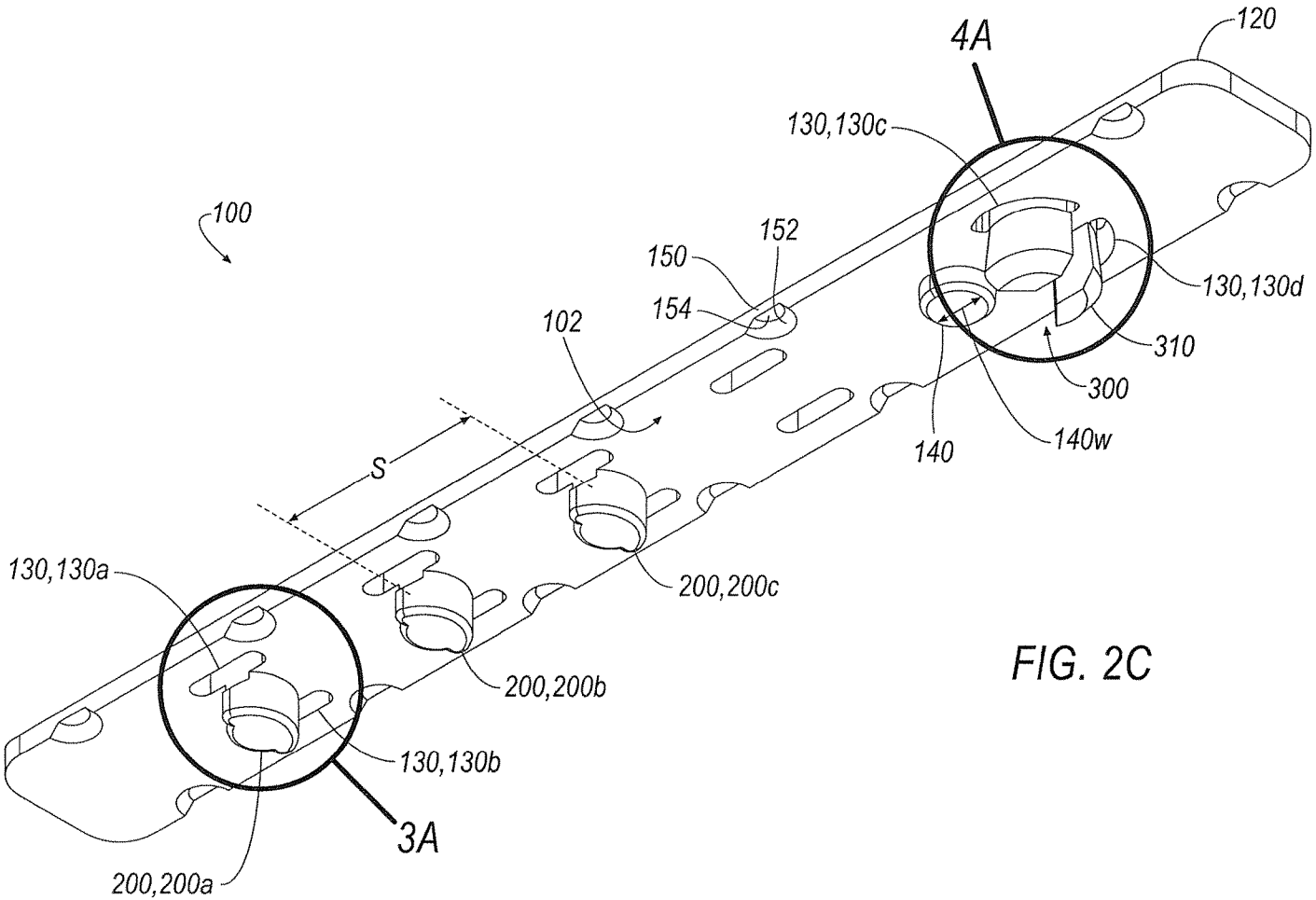
FIG. 2C is an example perspective view of a rail side of a rail insert.
Figure 2E:
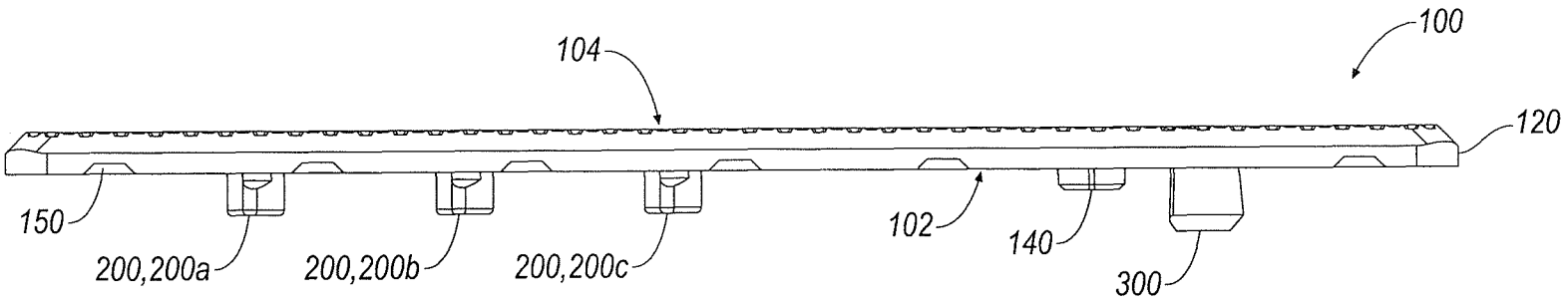
FIG. 2E is an example side view of a medial side of a rail insert.
Figure 2F:
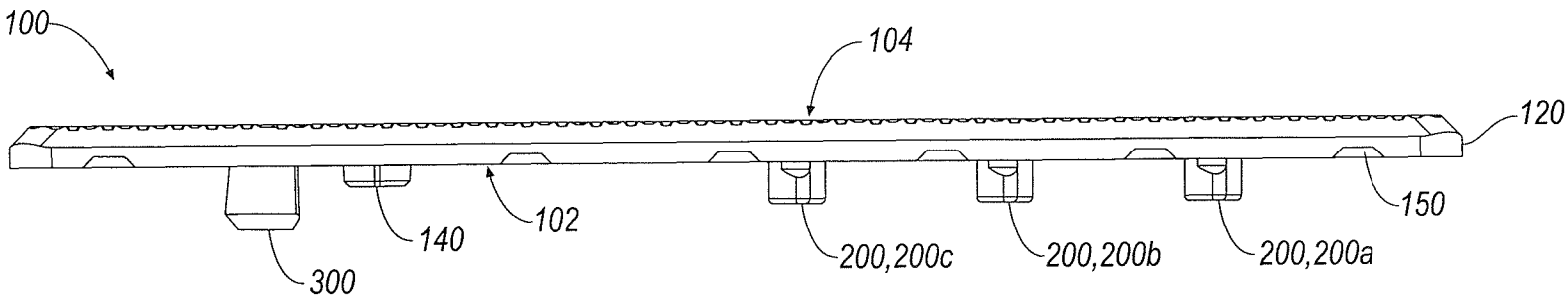
FIG. 2F is an example side view of a lateral side of a rail insert.

FIG. 1C is an example firearm environment 10 that includes the firearm rail 12, the at least one rail key slot 14, and a rail insert 100. The rail insert 100 has backing member 120 with a rail side 102 and a grip side 104. The backing member 120 of the rail insert 100 is removably mounted to the firearm rail 12 as a firearm attachment. The rail insert 100 is disposed on the firearm rail 12 such that the rail insert 100 engages with at least one rail key slot 14. When the backing member 120 of the rail insert 100 is disposed on the firearm rail 12, the rail side 102 of the backing member 120 faces the firearm rail 12 and the grip side 104 of the backing member 120 faces outward or away from the firearm rail 12. In some examples, the backing member 120 of the rail insert 100 is generally planar.

Referring to FIGS. 2A-F, the rail insert 100 includes the backing member 120, at least one locating pin 200, and at least one locking pin 300. For ease of explanation, the rail insert 100 is a generally described herein as a six-sided rectangular prism, but a skilled artisan may apply the disclosed concepts and features herein to other shapes (e.g., other prisms, cubes, cylinders). As a six-sided rectangular prism, the rail insert 100 has the rail side 102, the grip side 104, a proximal side 106, a distal side 108, a lateral side 110, and a medial side 112. The proximal side 106 corresponds to the muzzle end of the firearm. The distal side 108 is opposite the proximal side 106. Referring back to FIG. 1C, the lateral side 110 is a surface of the rail insert 100 that faces the firearm rail lateral side 12*l* and the medial side 112 is a surface of the rail insert 100 that faces the firearm rail medial side 12*m*. In some examples, the rail insert 100 may be positioned on at least one rail key slot 14 on the firearm rail lateral side 12*l*. When the rail insert 100 is positioned on at least one rail key slot 14 on the firearm rail lateral side 12*l*, the lateral side 110 of the rail insert 100 faces the ground plane when the firearm with the firearm rail 12 is in the upright firing position $F_p$. In some implementations, the rail insert 100 may be positioned on at least one rail key slot 14 on the firearm rail medial side 12*m*. When the rail insert 100 is positioned on at least one rail key slot 14 on the firearm rail medial side 12*m*, the medial side 112 of the rail insert 100 faces the ground plane when the firearm with the firearm rail 12 is in the upright firing position $F_p$.

Referring to FIGS. 2A-B, 2E-F, the rail insert 100 includes the grip side 104. In some examples, the grip side 104 has at least one grip indentation 105. The at least one grip indentation 105 is a recess into a surface plane of the grip side 104 of the rail insert 100. The at least one grip indentation 105 includes a side wall and a base portion. The side wall of the at least one grip indentation 105 has a top edge that intersects the surface plane of the grip side 104 of the rail insert 100. The base portion of the at least one grip indentation 105 is defined by a plane of the base portion that is parallel to the surface plane of the grip side 104 such that a height of the side wall of the grip indentation 105 defines a distance between the surface plane of the grip side 104 and the plane of the base portion. In some implementations, the grip side 104 includes a plurality of grip indentations 105. Each grip indentation 105 of the plurality of grip indentations 105 may have identical side wall and base portion dimensions or may vary the dimensions of the side wall and the base portion of each grip indentation. For example, in FIGS. 2A-B, 2E-F, the grip side 104 of the rail insert 100 has a plurality of grip indentations 105. The plurality of grip indentations 105 includes grip indentations 105 of identical side wall and base portion dimensions (e.g., 105*a* and 105*b*) and also grip indentations 105 that have a larger base portion (e.g., 105*c*). When the grip side 104 of the rail insert 100 includes a plurality of grip indentations 105, the grip indentations 105 may form an array throughout the grip side 104, be selectively arranged throughout the grip side 104, or be a combination of selectively arranged and arrayed throughout the grip side 104.

Further referring to FIGS. 2A-B, 2E-F, in some examples, the rail insert 100 has more than one opening 130. Each opening 130 of the more than one opening 130 may be configured to provide flexion, transfer heat from firearm, or aid as a mold release point for removal of the rail insert 100 during a molding process. Each opening 130 may be positioned such that each opening 130 is disposed upon a corresponding rail key slot 14. In some implementations, an opening 130 of the more than one opening 130 may have a longitudinal axis parallel to the longitudinal axis of the firearm rail 12. In some examples, a pair of openings 130*a*, 130*b* may align with a corresponding rail key slot 14. The shape of each opening 130 may vary. For example, the shape of each opening 130 may be configured to provide flexion, heat transfer, or mold release. As an example, FIGS. 2A-B, 2E-F depicts a plurality of openings 130. Some of the openings 130 of the plurality of openings 130 have a slot shape (e.g., 130*a* and 130*b*), while other openings 130 of the plurality of openings 130 have an arc shape (e.g., 130*c*, 130*d*).

FIGS. 2C-D, 2E-F are examples of the rail side 102 of the backing member 120 of the rail insert 100. The rail side 102 of the backing member 120 includes at least one locating pin 200 and at least one locking pin 300 connected to the backing member 120. The backing member 120 may have more than one locating pin 200 (e.g., 200*a*, 200*b*, 200*c*) such that each locating pin 200 of the more than one locating pin 200 has the spacing S corresponding to more than one rail key slots 14. In some examples, the spacing S of the more than one locating pin 200 may be an integer multiple, n, of spacing S (e.g., nS=2S, 3S, 4S, etc.) such that each rail key slot 14 does not necessarily have a corresponding locating pin 200 even though the backing member 120 has more than one locating pin 200. For example, the FIGS. 2C-D, 2E-F depict the backing member 120 having three locating pins 200, 200*a-c* with spacing S. The locating pin 200, 200*a* and the locating pin 200, 200*c* have the spacing 2S.

Referring further to FIGS. 2C-D, 2E-F, the rail side 102 of backing member 120 includes at least one locking pin 300 connected to the backing member 120. The at least one locking pin 300 having at least one compressible member 310. The at least one locking pin 300 is configured to engage with at least one rail key slot 14 of the firearm rail 12. In some implementations, the rail side 102 of the backing member 120 includes a locking guide 140. The locking guide 140 is coupled with a locking pin 300 of the at least one locking pin 300 such that the locking guide 140 aligns the locking pin 300 in at least one rail key slot 14 of the firearm rail 12. The locking guide 140 may align the locking pin 300 such that the locking guide 140 interferes with a portion of at least one rail key slot 14 and permits the locking pin 300 to engage with at least one rail key slot 14. The locking guide 140 may align the locking pin 300 with the same rail key slot 14 of the firearm rail 12 that the locking guide 140 interferes with or a different rail key slot 14 of the firearm rail 12. The locking guide 140 may have a locking guide width 140*w* substantially equal to the width $\mathbf{14}w_s$ of the slot portion 14*sp* of the rail key slot 14. In some examples, the locking guide 140 and the corresponding locking pin 300 are offset by a distance that permits the locking guide 140 and the corresponding locking pin 300 to span the length 14*l* of the same rail key slot 14. As shown in FIGS. 2C-D, 2E-F, the locking guide 140 is cylindrically shaped to correspond to the slot portion 14*sp* of rail key slot 14, but the locking guide 140 may be any shape that permits the locking pin 300 to engage with at least one rail key slot 14.

Alternatively or additionally, the rail side 102 of the backing member 120 has at least one ejection indentation 150. The at least one ejection indentation 150 is a recess into a surface of the rail side 102 of the backing member 120 and an adjacent side of the backing member 120 to the rail side 102 (e.g., the proximal side 106, the distal side 108, the lateral side 110, and the medial side 112). The recess of the at least one ejection indentation 150 is defined by an ejection indentation side wall 152 and an ejection indentation base 154. At least one edge of the at least one ejection indentation 150 is defined by an intersection of the surface of the rail side 102 and a surface of the adjacent side of the backing member 120 to the rail side 102. A height of the ejection indentation side wall 152 corresponds to a depth of the recess into the surface of the rail side 102 such that the surface of the rail side 102 is parallel to a plane of the ejection indentation base 154. In some implementations, the at least one ejection indentation 150 may be defined by three sides of the backing member 120 (e.g., defined by a corner of the backing member 120). In the examples of FIGS. 2C-D, 2E-F, the rail side 102 of the backing member 120 has a plurality of ejection indentations 150 along the lateral side 110 and the medial side 112 of the backing member 120.

Figure 3A:
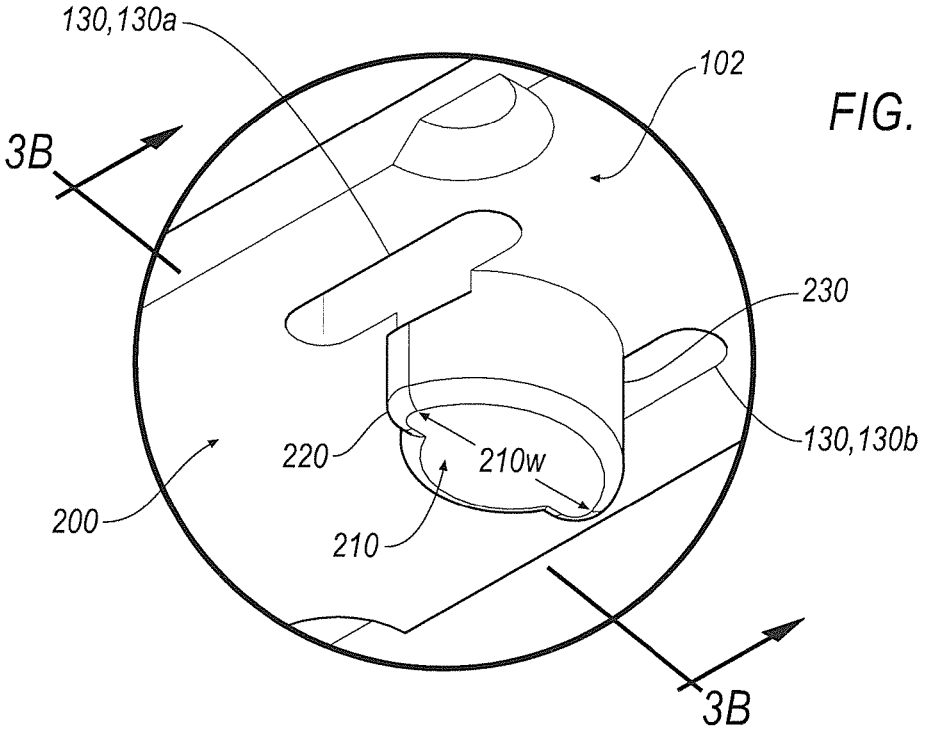
FIG. 3A is an enlarged example of a locating pin.
Figure 3B:
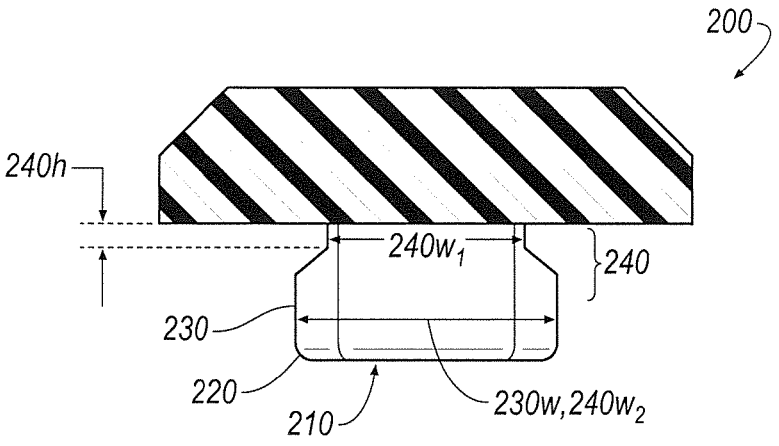
FIG. 3B is an enlarged example of a sectional view of a locating pin.

FIG. 3A-3B are examples of the locating pin 200. The locating pin 200 is configured in a shape that engages with at least one rail key slot 14. To engage with at least one rail key slot 14, the locating pin 200 has an engaging surface 210 that may be positioned within the at least one rail key slot 14. The engaging surface 210 of the locating pin 200 has a width 210*w* substantially equal or less than the width $\mathbf{14}w_b$ of the bow portion 14*bp* of the at least one rail key slot 14.

In some implementations, the locating pin 200 includes a chamfered portion 220 that shares an edge with the engaging surface 210 such that the width 210*w* of the engaging surface 210 of the locating pin 200 is less than the width $\mathbf{14}w_b$ of the bow portion 14*bp* of the at least one rail key slot 14. In these implementations, the locating pin 200 transitions by the chamfered portion 220 from the engaging surface 210 to a body portion 230 such that the body portion 230 has a main width 230*w* greater than the width 210*w* of the engaging surface 210. The chamfered portion 220 of the locating pin 200 may permit the locating pin 200 to frictionally fit within the at least one rail key slot 14.

In some examples, the width 200*w* of the locating pin 200 may be less than the width 14*wb* of the bow portion 14*bp* of the at least one rail key slot 14 such that the locating pin 200 in the at least one rail key slot 14 forms a frictional fit with the slot portion 14*sp* of the at least one rail key slot 14. Additionally or alternatively, the locating pin 200 may be a shape configured to form the frictional fit with both the bow portion 14*bp* and the slot portion 14*sp* of the at least one rail key slot 14.

In some examples, the locating pin 200 is configured to a shape that permits the locating pin 200 to travel from a first rail key slot position $P_1$ to a second rail key slot position $P_2$. The first rail key slot position $P_1$ is a location where the locating pin 200 is positioned within the bow portion 14*bp* of the at least one rail key slot 14. The second rail key slot position $P_2$ is a location where the locating pin 200 is positioned within the slot portion 14*sp* of the rail key slot 14 at an end opposite the bow portion 14*bp* of the rail key slot 14.

FIG. 3B is an example of a shape that permits the locating pin 200 to travel from the first rail key slot position $P_1$ to the second rail key slot position $P_2$. The locating pin 200 includes the body portion 230 with a shoulder portion 240. The shoulder portion 240 is defined by a first width $\mathbf{240}w_1$ of the shoulder portion 240 adjacent to the backing member 120 that is less than a second width $\mathbf{240}w_2$ (i.e. 230*w*) of the shoulder portion 240 opposite the backing member 120. The first width $\mathbf{240}w_1$ of the shoulder portion 240 spans a height 240*h* that may be greater than or substantially equal to the thickness t of the firearm rail 12. In some implementations, the shoulder portion 240 is disposed above at least one opening 130 (e.g., 130*a* or 130*b*) or part of the at least one opening 130.

Figure 4A:
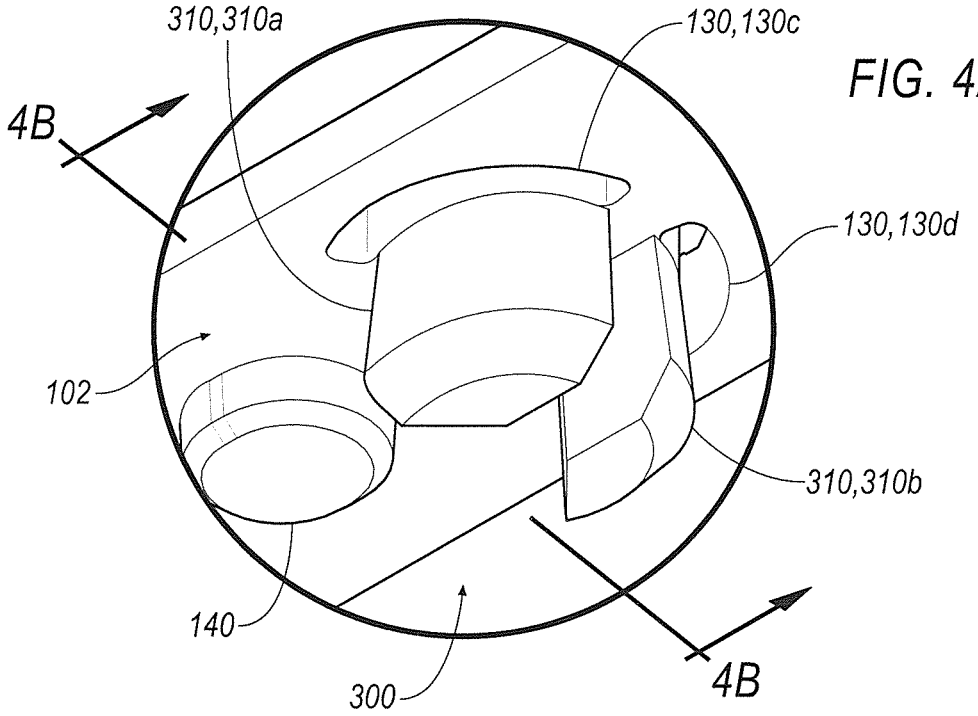
FIG. 4A is an enlarged example of a perspective view of a locking pin.
Figure 4B:
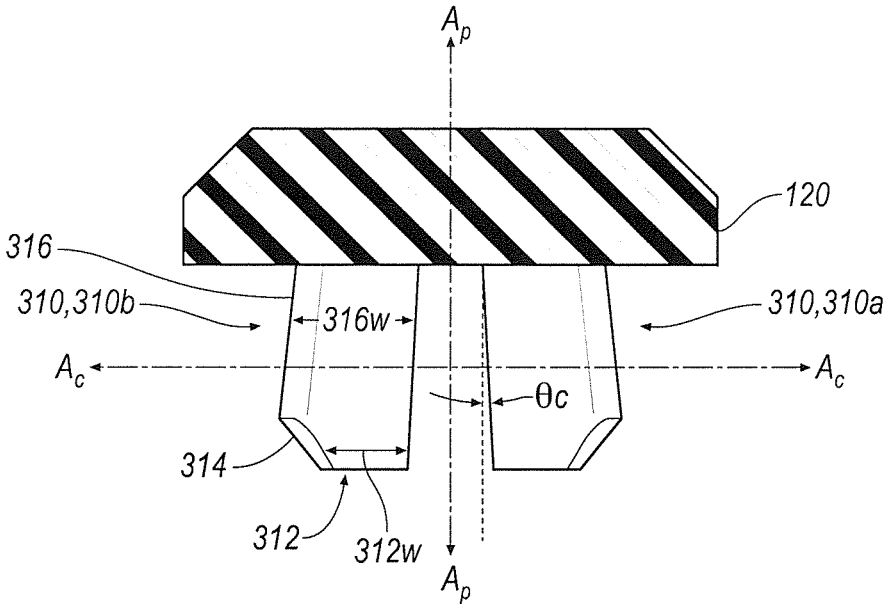
FIG. 4B is an enlarged example of a sectional view of a locking pin.

Referring to FIGS. 4A-B, the rail insert 100 has at least one locking pin 300 connected to the backing member 120 on the rail side 102 of the backing member 120. The at least one locking pin 300 includes at least one compressible member 310. In some examples, the at least one locking pin 300 has a first compressible member 310, 310*a* and a second compressible member 310, 310*b*.

In some implementations, the at least one compressible member 310 is compressible along an axis $A_c$ that is generally parallel to the generally planar backing member 120. The at least one compressible member 310 may permit the locking pin 300 to be positioned within the at least one rail key slot 14. For example, as the locking pin 300 engages with the at least one rail key slot 14, the at least one compressible member 310 compresses along the axis $A_c$ that is generally parallel to the generally planar backing member 120 until the locking pin 300 is positioned within the at least one rail key slot 14. The locking pin 300 may continue to be in a compressed state as the locking pin 300 remains positioned within the rail key slot 14 or the locking pin 300 may decompress after the locking pin 300 is positioned within the rail key slot 14.

FIG. 4B is an example of the locking pin 300. The locking pin 300 may include two compressible members 310*a* and 310*b*. Each compressible member 310 may include an engaging surface portion 312, a chamfered portion 314, and a body portion 316. During engagement of the locking pin 300 and the firearm rail 12, the engaging surface portion 312 of at least one compressible member 310 is parallel to the surface of the firearm rail 12. The compressible member 310 transitions from the engaging surface portion 312 to the body portion 316 by the chamfered portion 314 such that the engaging surface portion 312 has a width 312*w* less than the width 316*w* of the body portion 316 of the compressible member 310. The locking pin 300 may engage with the at least one rail key slot 14 by interference such that the chamfer portion 314 of the compressible member 310 frictionally engages with at least one rail key slot 14 as the compressible member 310 compresses along the axis $A_c$.

In some examples, the compressible member 310 is positioned at a compression angle $\theta_c$ away from an axis $A_p$ perpendicular to the generally planar backing member 120 prior to compression. In these examples, compression of the compressible member 310 along the axis $A_c$ causes the compressible member 310 to reduce the compression angle $\theta_c$ relative to the axis $A_p$ perpendicular to the generally planar backing member 120 until the locking pin 300 is positioned within the at least one rail key slot 14.

Figure 5A:
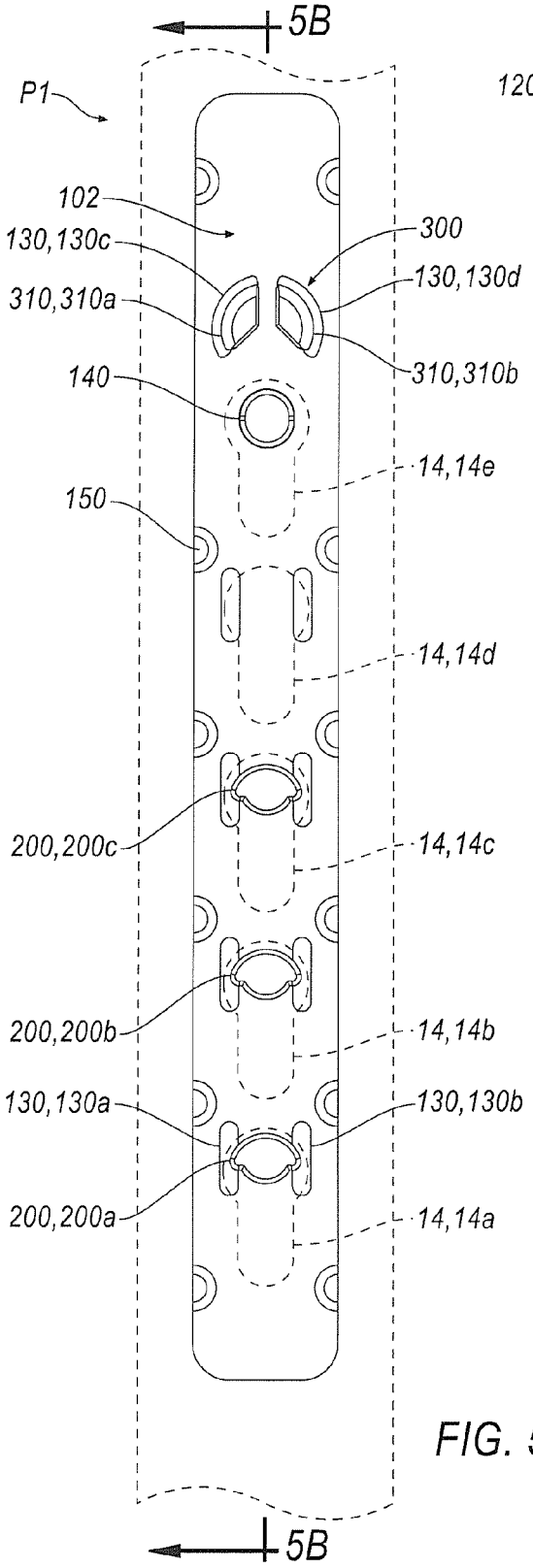
FIG. 5A is an example top view of a rail insert and a firearm rail.

FIGS. 5A-5D are examples of the backing member 120 of the rail insert 100 engaging with the firearm rail 12. Referring to FIG. 5A, at least one locating pin 200 is inserted within at least one rail key slot 14 to position the rail insert 100 in the first rail key slot position $P_1$. In some examples, the at least one locating pin 200 is inserted within the bow portion 14*bp* of the at least one rail key slot 14. For example, FIG. 5A illustrates three locating pins 200, 200*a*-200*c* are positioned within the bow portions 14*bp* of three corresponding rail key slots 14, 14*a-c*.

Figure 5B:
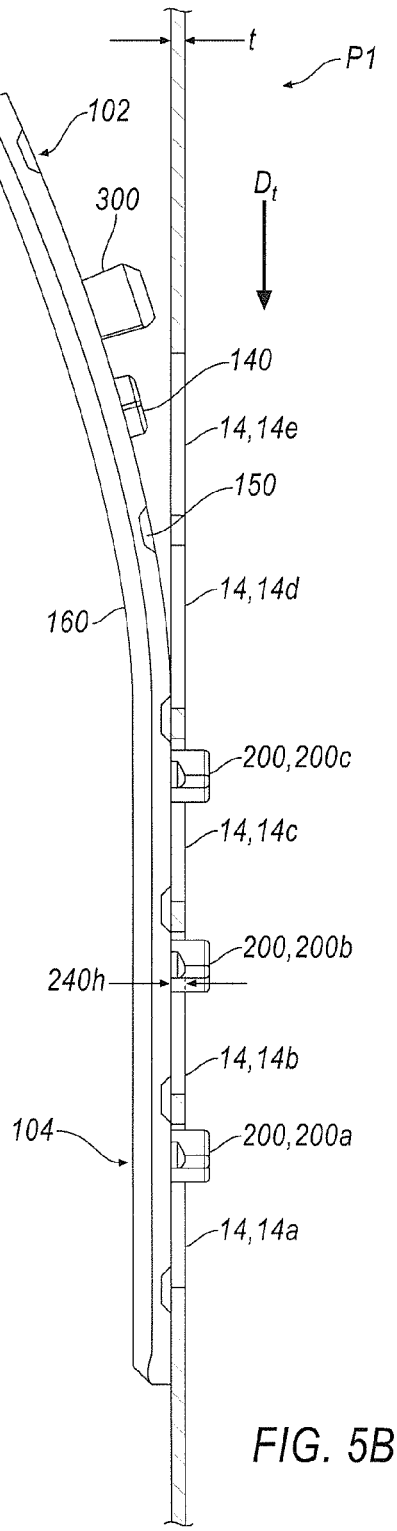
FIG. 5B is an example side view of a rail insert and a firearm rail.

FIG. 5B is a side view of example of the backing member 120 of the rail insert 100 engaging with the firearm rail 12 in the first rail key slot position $P_1$. The at least one locating pin 200 is inserted in at least one rail key slot 14 of the firearm rail 12 such that the height 240*h* spanned by the first width 240$w_1$ of the shoulder portion 240 of the at least one locating pin 200 either extends substantially equal to the thickness t of the firearm rail 12 or extends beyond the thickness t of the firearm rail 12. In some examples, the rail insert 100 has a flexion portion 160 that permits the at least one locating pin 200 to be inserted into at least one corresponding rail key slot 14 before either the locking guide 140 or the locking pin 300 is positioned within at least one rail key slot 14 of the firearm rail 12.

Figure 5C:
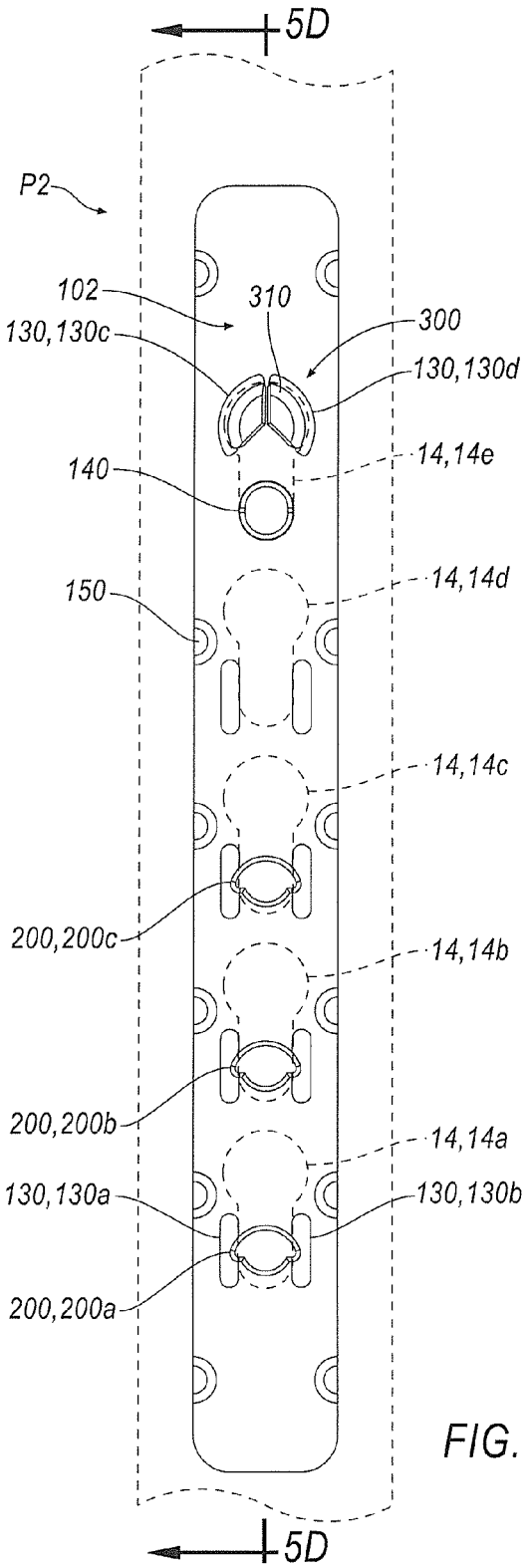
FIG. 5C is an example top view of a rail insert and a firearm rail.

Referring to FIG. 5C, the backing member 120 of the rail insert 100 has been maneuvered from the first rail key slot position $P_1$ to the second rail key slot position $P_2$. At the second rail key slot position $P_2$, the at least one locating pin 200 is positioned within the slot portion 14*sp* of the at least one rail key slot 14. For example, FIG. 5A illustrates three locating pins 200, 200*a*-200*c* are positioned within the slot portions 14*sp* of three corresponding rail key slots 14, 14*a-c*. The locking guide 140 connected to the backing member 120 is positioned within a corresponding rail key slot 14 such that the locking pin 300 is inserted within the firearm rail 12. In some examples, the locking guide 140 may be positioned within the same rail key slot 14 of the locking pin 300 such that the locking guide 140 is positioned within the slot portion 14*sp* of the rail key slot 14 and the locking pin 300 is positioned with the bow portion 14*bp* of the rail key slot 14. In other examples, the locking guide 140 may be a spacing from the locking pin 300 such that the locking guide 140 positions the locking pin 300 within a different rail key slot 14 than the locking guide 140 of the firearm rail 12.

Figure 5D:
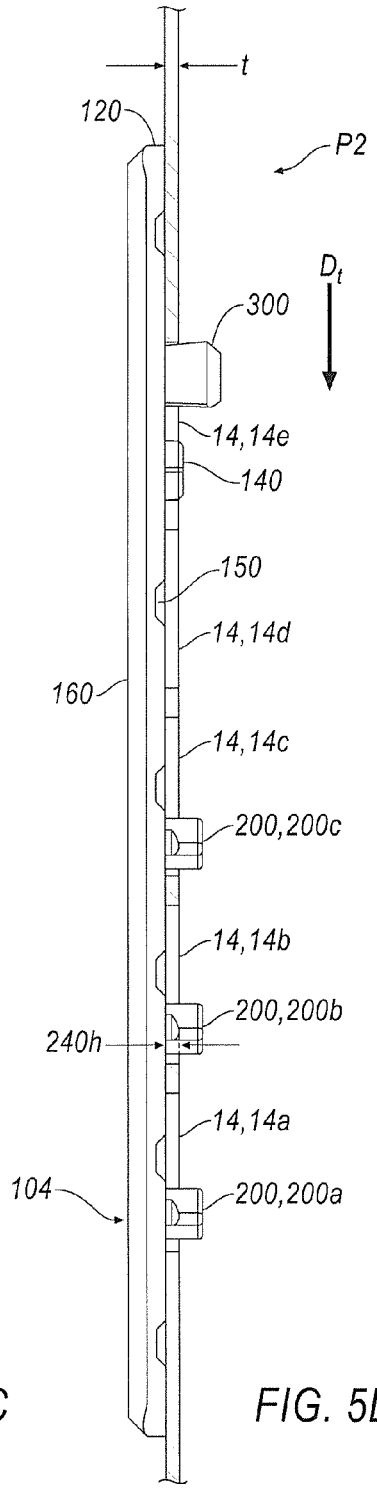
FIG. 5D is an example side view of a rail insert and a firearm rail.

FIG. 5D is a side view of the rail insert 100 in the second rail key slot position $P_2$. In the second rail key slot position $P_2$, the at least one locating pin 200 of the backing member 120 has slid from the bow portion 14*bp* of the at least one rail key slot 14 to the slot portion 14*sp* of the at least one rail key slot 14. The at least one locating pin 200 may slide from the first rail key slot position $P_1$ to the second rail key slot position $P_2$ because the first width 240$w_1$ of the shoulder portion 240 minimizes interference between the at least one locating pin 200 and the at least one corresponding rail key slot 14. When in the second rail key slot position $P_2$, the locking pin 300 is seated within a corresponding rail key slot 14. When the rail insert 100 is in the second rail key slot position $P_2$, the rail insert 100 is locked in place on the firearm rail 12 by at least one degree of interference. The at least one degree of interference may be from tension against the firearm rail 12 once inserted within at least one rail key slot 14 of the firearm rail 12 by the at least one compression member 310 of the locking pin 300, from the second width 240$w_2$ of the shoulder portion 240 of at least one locating pin 200 being greater than the width 14$w_s$ of the slot portion 14*sp* of the rail key slot 14 corresponding to the at least one locating pin 200, or both.

In some implementations, the direction of travel $D_t$ that the rail insert 100 may slide to be in the second rail key slot position $P_2$ depends on the orientation of rail key slot 14. For example, the rail insert 100 may slid towards the muzzle end of the firearm rail 12 if the slot portion 14*sp* of the rail key slot 14 faces the muzzle end of the firearm rail 12; but in other examples, the rail insert 100 may slide away from the muzzle end of the firearm rail 12 to permit at least one locating pin 200 to engage with the slot portion 14*sp* of the at least one rail key slot 14 because the slot portion 14*sp* faces away from muzzle end of the firearm rail 12.

Figure 6:
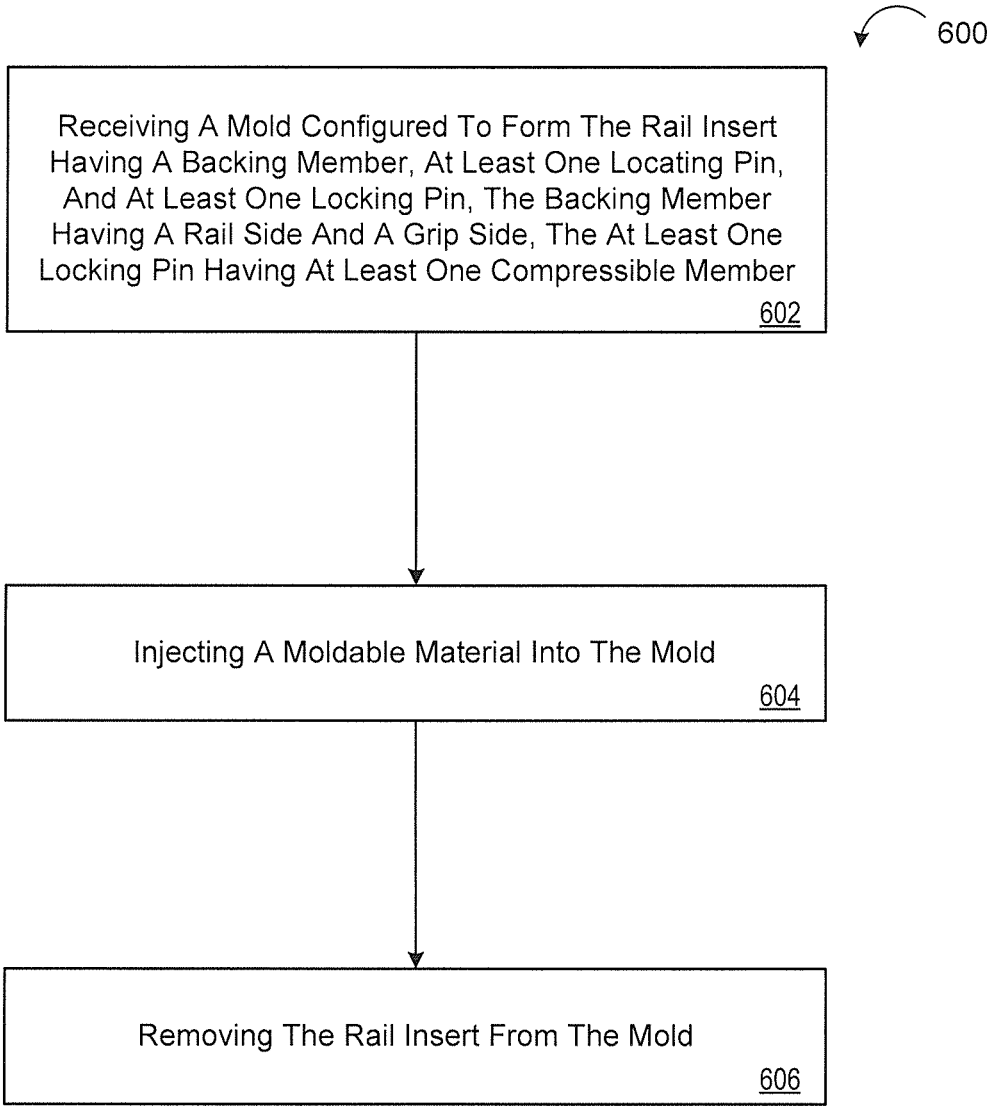
FIG. 6 is block diagram example of a method of making a rail insert.

FIG. 6 provides an example arrangement of operations of a method 600 of making a rail insert 100. At block 602, the method 600 includes receiving a mold configured to form the rail insert 100 that has a backing member 120 with a rail side 102 and a grip side 104, at least one locating pin 200, and at least one locking pin 300 with at least one compressible member 310. As an example, the locking pin 300 may have a first compressible member 310, 310*a* and a second compressible member 310, 310*b*. The grip side 104 of the backing member 120 may include a plurality of grip indentations 105 (e.g., 105*a-c*). The backing member 120 may further include at least one ejection indentation 150. At block 604, the method 600 includes injecting a moldable material into the mold. At block 606, the method 600 includes removing the rail insert 100 from the mold. At block 602, the method 600 may include a generally planar backing member 120. Alternatively, the method 600 may include at least one compressible member 310 that is compressible along an axis $A_c$ that is generally parallel to a generally planar backing member 120. The at least one compressible member 310 may have a chamfered portion 314 that engages with a firearm rail 14. The method of 600 may further include at least one locating pin 200 with a shoulder portion 240. The shoulder portion 240 is defined by a first width 240$w_1$ of the shoulder portion 240 adjacent to the backing member 120 that is less than a second width 240$w_2$ of the shoulder portion 240 opposite the backing member 120.

A number of implementations have been described. Nevertheless, it will be understood that various modifications may be made without departing from the spirit and scope of the disclosure. Accordingly, other implementations are within the scope of the following claims.

What is claimed is:

1. A rail insert for engaging a firearm rail having a first rail key slot and a second rail key slot spaced apart from the first rail key slot, each of the first and second rail key slots having a slot portion defining a first width extending in a first direction and a bow portion defining a second width extending in the first direction, the second width being greater than the first width, the rail insert comprising:

a backing member;

a locating pin connected to the backing member and configured to be disposed within the first rail key slot such that the locating pin engages the firearm rail proximate to the slot portion of the first rail key slot;

a locking pin connected to the backing member and having at least one compressible member configured to be disposed within the second rail key slot such that the at least one compressible member engages the firearm rail proximate to the bow portion of the second rail key slot; and a locking guide disposed between the locating pin and the locking pin, the locking guide configured to be disposed within the second rail key slot such that the locking guide engages the firearm rail proximate to the slot portion of the second rail key slot.

2. The rail insert of claim 1, wherein the rail insert is moveable between a first rail key slot position and a second rail key slot position, the second rail key slot position having the locating pin within the slot portion of the at least one rail key slot and the locking pin engaged within the bow portion of the at least one rail key slot.

* * * * *